US008925892B2

(12) United States Patent
Germenot

(10) Patent No.: US 8,925,892 B2
(45) Date of Patent: Jan. 6, 2015

(54) SUPPORT DEVICE FOR THE GUN SIGHT OF A MILITARY VEHICLE

(75) Inventor: Olivier Germenot, Versailles (FR)

(73) Assignee: Nexter Systems, Roanne (FR)

( * ) Notice: Subject to any disclaimer, the term of this patent is extended or adjusted under 35 U.S.C. 154(b) by 354 days.

(21) Appl. No.: 13/297,835

(22) Filed: Nov. 16, 2011

(65) Prior Publication Data

US 2012/0132782 A1 May 31, 2012

(30) Foreign Application Priority Data

Nov. 25, 2010 (FR) ..... 10 04609

(51) Int. Cl.

| | |
|---|---|
| ***F16M 13/00*** | (2006.01) |
| ***F41A 25/00*** | (2006.01) |
| ***F16F 1/36*** | (2006.01) |
| ***F41G 1/46*** | (2006.01) |
| ***F41G 1/393*** | (2006.01) |

(52) U.S. Cl.

CPC . *F41G 1/46* (2013.01); *F41G 1/393* (2013.01)

USPC ..... 248/636; 248/603; 248/604; 248/605; 248/606; 248/176.1; 248/158; 248/676; 248/125.8; 248/570; 248/613; 267/147; 267/148; 267/160; 267/136; 267/158; 267/137; 267/140.11; 267/229; 267/36.1; 89/44.01; 89/44.02; 89/42.01; 89/37.01

(58) Field of Classification Search

USPC ..... 248/176.1, 622, 631, 611, 581, 613, 248/438, 570, 125.8, 188.5, 158, 676, 43, 248/559–560, 603–606; 267/147, 148, 160, 267/136, 158, 137, 140.11, 229, 36.1; 89/44.01, 44.02, 42.01, 37.01

See application file for complete search history.

(56) References Cited

U.S. PATENT DOCUMENTS

| | | | | | |
|---|---|---|---|---|---|
| 3,086,600 | A | * | 4/1963 | Kerley, Jr. | 173/131 |
| 3,904,163 | A | * | 9/1975 | Kendy et al. | 248/565 |
| 4,499,772 | A | * | 2/1985 | Haas | 73/666 |
| 5,377,950 | A | * | 1/1995 | Salcudean et al. | 248/581 |
| 5,443,247 | A | * | 8/1995 | Polites et al. | 267/283 |
| 5,529,277 | A | * | 6/1996 | Ostaszewski | 248/603 |
| 5,678,809 | A | * | 10/1997 | Nakagawa et al. | 267/148 |

(Continued)

FOREIGN PATENT DOCUMENTS

| | | |
|---|---|---|
| EP | 0508 684 A2 | 10/1992 |
| EP | 2 146 176 A2 | 1/2010 |

OTHER PUBLICATIONS

French Search Report dated Jul. 4, 2011 issued in French Patent Application No. 1004609 (with translation).

*Primary Examiner* — Christopher Garft

(74) *Attorney, Agent, or Firm* — Oliff PLC

(57) ABSTRACT

The invention relates to a support device for the gun sight of a military vehicle, incorporating a head to which the gun sight is fastened and a foot which is integral with the vehicle, the head being integral with a column with a vertical axis which is introduced into the foot, the column being made integral with the foot by spring means wherein the spring means are constituted in the form of tongues arranged along at least two parallel planes perpendicular to the vertical axis of the support, each plane incorporating at least three tongues evenly spaced angularly around the column and integral with it by a first end and integral with the foot by their second end, these spring means imparting stiffness to the link between the column and the foot that is less along the vertical axis than along the other directions (X, Y) orthogonal to this vertical axis.

15 Claims, 6 Drawing Sheets

(56) References Cited

U.S. PATENT DOCUMENTS

| | | | | |
|---|---|---|---|---|
| 5,710,945 | A * | 1/1998 | Thompson | 396/13 |
| 5,907,880 | A * | 6/1999 | Durazzani et al. | 8/159 |
| 6,530,563 | B1 * | 3/2003 | Miller et al. | 267/136 |
| 6,629,688 | B1 * | 10/2003 | Sebert | 267/147 |
| 2006/0254869 | A1 * | 11/2006 | Wang | 188/378 |
| 2008/0035770 | A1 * | 2/2008 | Schieweg | 241/91 |
| 2009/0072116 | A1 * | 3/2009 | Fielding | 248/638 |
| 2010/0011952 | A1 * | 1/2010 | Anderson | 89/44.02 |

* cited by examiner

SUPPORT DEVICE FOR THE GUN SIGHT OF A MILITARY VEHICLE

BACKGROUND OF THE INVENTION

1. Field of the Invention

The technical scope of the invention is that of supports for gun sights for military vehicles.

2. Description of the Related Art

On a military vehicle equipped with a gun sight, firing accuracy is due in part to the capacity of the sight to have a known fixed position on the vehicle. This is particularly true for boresighting, for example.

The environment in which military vehicles equipped with a gun sight in a superstructure evolve often generates strong and intense vibrations due to travel and firing. The vertical vibratory stresses are the strongest and the most detrimental to the durability of the electronic equipment forming part of modern a gun sight.

Thus, a person skilled in the art wishing to integrate such a sight onto a military vehicle must fulfill contradictory requirements of assembly rigidity to ensure accuracy and stability of aim on the one hand, and requirements of flexibility and suspension to ensure the resistance and durability of the sight on the other.

A device to mount an inertial unit on an artillery system is known by patent EP2146176. In this device, a parallepipedic inertial unit is suspended by means of elastomer shock isolators placed on two of its parallel vertical faces. In this way, the unit damps the vertical stresses as well as the transversal stresses along an axis parallel to the faces on which the shock isolators are fixed.

This device suffers from drawbacks, however. The main drawback being that, in the case of a gun sight, the vibrations in the horizontal plane are such that a mounting that is not or is barely suspended is a requisite to contribute to firing accuracy. However, shock isolators such as those disclosed in EP2146176 leave a considerable degree of freedom in the horizontal plane which perturbs aiming. It must be noted that vibrations in a horizontal plane can generally be absorbed by gun sights.

A second drawback linked to the device proposed in EP2146176 comes from the fact that the elastomers generate hysteresis phenomena and are highly sensitive to climatic elements. Additionally, elastomers have a limited life and their properties evolve over time.

A damping device for a gun sight is known by patent EP0508684 that incorporates a single ring-shaped shock isolator made of a polymer material able to absorb shocks along a vertical axis. Travel in the plane perpendicular to the suspension axis is limited by the annular contact of a column supporting the sight with an insulating O-ring on a lower part of the sight.

The friction caused by the O-ring on the column generates hysteresis phenomena due to the adherence and friction of the O-ring. Additionally, the elastomer forming the O-ring has a limited life.

SUMMARY OF THE INVENTION

The invention proposes a support device for a gun sight able to provide suspension but reducing sensitivity to hysteresis phenomena whilst strongly absorbing the low frequency acceleration levels along the vertical axis and supplying a relatively rigid link between the gun sight and the vehicle in the horizontal plane.

According to one variant, the invention proposes means that also enable the damping of the system to be improved so as to reduce the amplitudes of the assembly and the time to return to equilibrium between two stresses.

Thus, the invention relates to a support device for the gun sight of a military vehicle, incorporating a head to which the gun sight is fastened and a foot which is integral with the vehicle, the head being integral with a column with a vertical axis which is introduced into the foot, the column being made integral with the foot by spring means, device wherein the spring means are constituted in the form of tongues arranged along at least two parallel planes perpendicular to the vertical axis of the support, each plane incorporating at least three tongues evenly spaced angularly around the column and integral with it by a first end and integral with the foot by their second end, these spring means imparting stiffness to the link between the column and the foot that is less along the vertical axis than along the other directions orthogonal to this vertical axis.

The column may be rigidified by at least one ribbing integral with the column and the head.

Advantageously, the foot may be a square sectioned tubular shape.

In this case, each of the parallel planes may incorporate four spring tongues, the tongues being arranged following the diagonals of the square sectioned tubular shape.

Advantageously, each tongue may be plane and have a rectangular sectioned profile, with a substantial regular width and thickness along each tongue, the thickness, which is less than the width of the tongue, being oriented perpendicularly to the plane of the tongues and thus parallel to the vertical axis.

According to one embodiment, the tongues arranged on at least one of the planes may have a non-plane profile and will incorporate at least one wave enabling their tensile and compressive deformation capacity to be increased.

Advantageously, the tongues are made of spring steel.

According to another embodiment of the invention, the device may also incorporate means to damp the column's oscillations.

These oscillation-damping means may incorporate a telescopic shock isolator.

BRIEF DESCRIPTION OF THE DRAWINGS

The invention will become more apparent from the following description made with reference to the appended drawings, in which.

DETAILED DESCRIPTION OF PREFERRED EMBODIMENTS

Figure 1:
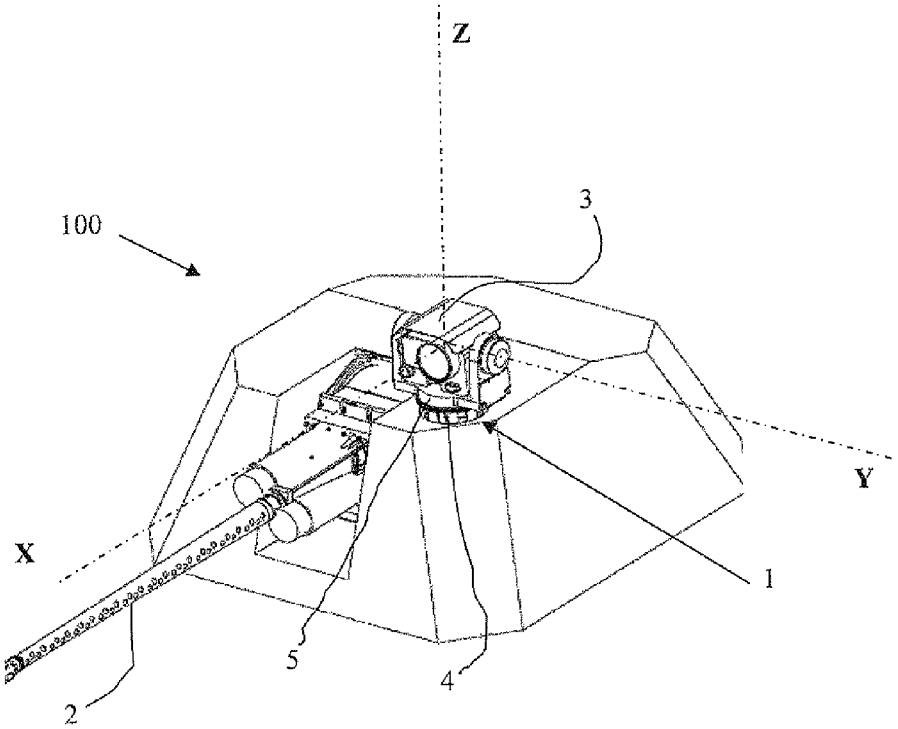
FIG. 1 shows a view of the support device equipped with a gun sight on the turret of a military vehicle?

With reference to FIG. 1, a turret 100 of a military vehicle incorporates a support 1 for a gun sight, placed vertically in proximity to a gun 2. At the top of this support there is a gun sight 3. This gun sight is able to spin around three axes; roll (axis X), pitch (axis Y) and yaw (vertical axis Z). The support 1 incorporates two visible parts. A first tubular part with a substantially square section integral with the turret 100 by its lower part, designated support foot 4. A second cylindrical part, designed support head 5, integral with the gun sight.

Figure 2:
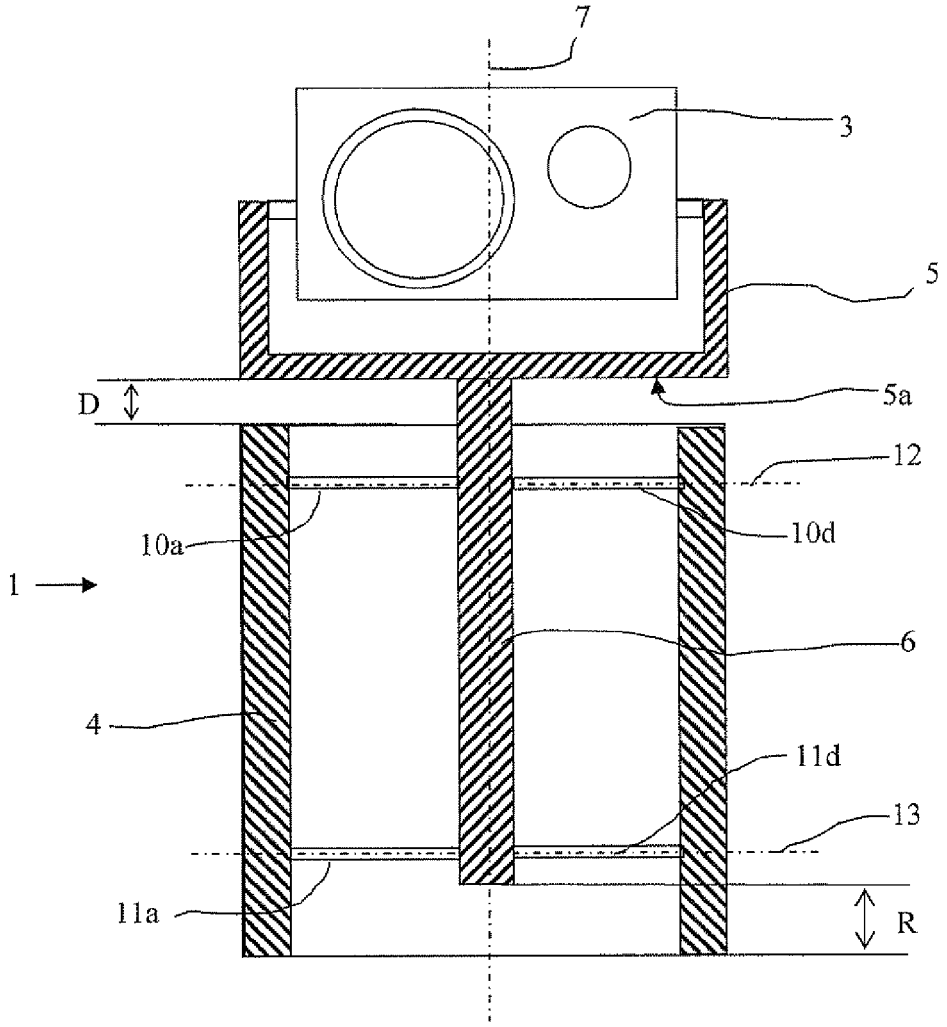
FIG. 2 shows a vertical section view of a first embodiment of this device.

In the horizontal plane, the lower part of the head 5 is spaced from the upper part of the foot 4 by a distance D (see FIG. 2)

With reference to FIG. 2, the device 1 according to a first embodiment incorporates a column 6 integral with the lower part of the head 5 of the support 1 and perpendicular to a surface designated bottom 5*a* of the head 5. This column 6 is coaxial to the vertical axis 7 passing through the support 1 and corresponds to the vertical axis of yaw rotation 7 of the gun sight 3 (or axis Z in FIG. 1).

According to this embodiment, the column 6 does not come to the lower end of the foot 4 and is retracted by a distance R with respect to the lower end of the foot 4. The column 6 is linked to the inside of the support foot 4 by two groups of planes springs 10*a* to 10*d* and 11*a* to 11*d*. A first group of plane springs 10*a* to 10*d* defining a first plane 12 perpendicular to axis 7. This first plane 12 is placed in the vicinity of the upper edge of the support foot 4. A second plane 13 perpendicular to axis 7 is defined by the second group of plane springs 11*a* to 11*d*. This second plane 13 is placed in the vicinity of the lower edge of the column 6.

Figure 3:
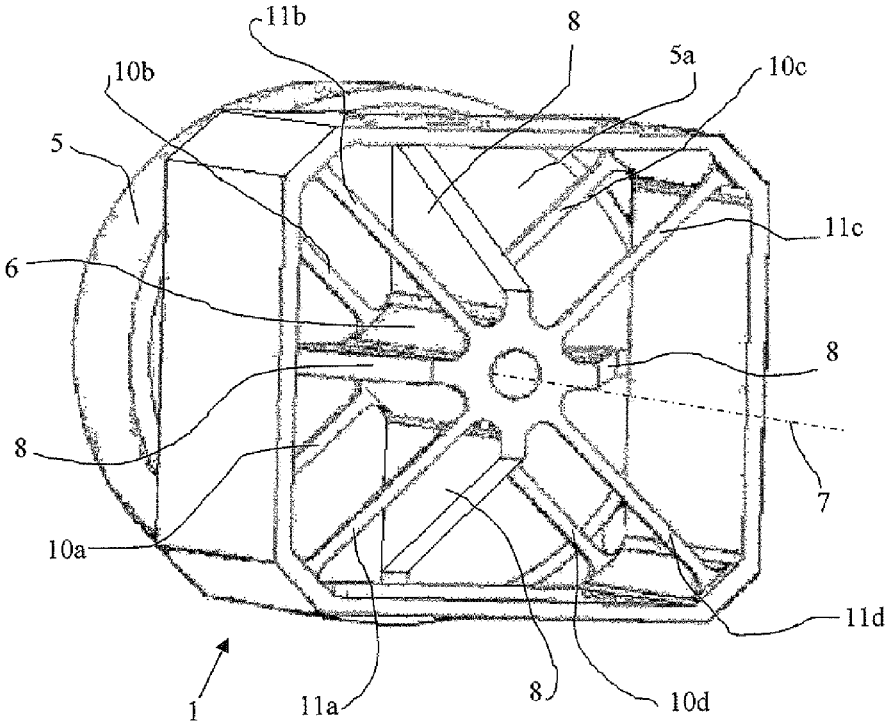
FIG. 3 shows a top view of this first embodiment of the device.

FIG. 3 shows a top perspective view of the device. It can be seen that the column 6 incorporates brackets 8 forming ribbing integral with the column 6 and the bottom 5*a* of the head 5 of the support 1. These brackets 8 rigidify the link between the column 6 and the support head 5.

The plane springs 10*a* to 11*d* are evenly spaced angularly around axis 7. According to the first embodiment described here, springs 10*a* to 11*d* have a rectangular section. Each spring is thus a tongue having a substantially regular width and thickness along each tongue. The thickness of each tongue is oriented along a direction parallel to axis 7 and is less than the width of the tongue. Thus, the thickness of each tongue is oriented perpendicularly to plane 12 or 13 defined by the tongues in question (thus in parallel to vertical axis Z or 7).

Thus, the stiffness of the spring is reduced in one direction of vertical deformation 7 whereas it is greater in the directions (X and Y) perpendicular to the vertical direction.

According to other embodiments, the spring tongues might be square, round or elliptical in section, but the smallest dimension of the spring tongue's section must be parallel to the vertical axis.

Each of plane springs 10*a* to 11*d* is integral with the column 6 by a first end and integral with the inside of the foot 4 of the support 1 by a second end.

When the support is subjected to vibratory stress, the vertical component of the motion transmitted generates an oscillation of the assembly formed of the support head 5 and the column 6 along the vertical axis 7.

At this time the plane springs 10*a* to 11*d* are evenly subjected to alternate bending stress. Following the other axes of stress transversal to the vertical axis 7, as the springs have rectilinear tongue shapes, they can only be subjected to slight tensile or compressive deformation. They thus block the degrees of freedom following these axes transversal to the vertical axis 7. The absence of any friction between the column 6 and the foot 4 also prevents any hysteresis phenomena.

Note in FIG. 2 that the support 1 incorporates distances D and R (retraction) between the head bottom 5*a* and the top of the foot 4 as well as between the bottom of the column 6 and that of the foot 4. These distances have a value greater than the foreseeable amplitude of the oscillations of the support head 5 equipped with the gun sight.

The springs will be chosen made of spring steel, for example with 33% nickel, 12% chromium, 1.2% manganese. Such steel has a Young's modulus that is practically independent of the temperature, and is namely less sensitive to the climatic conditions than springs made of polymer or plastic materials.

Figure 4:
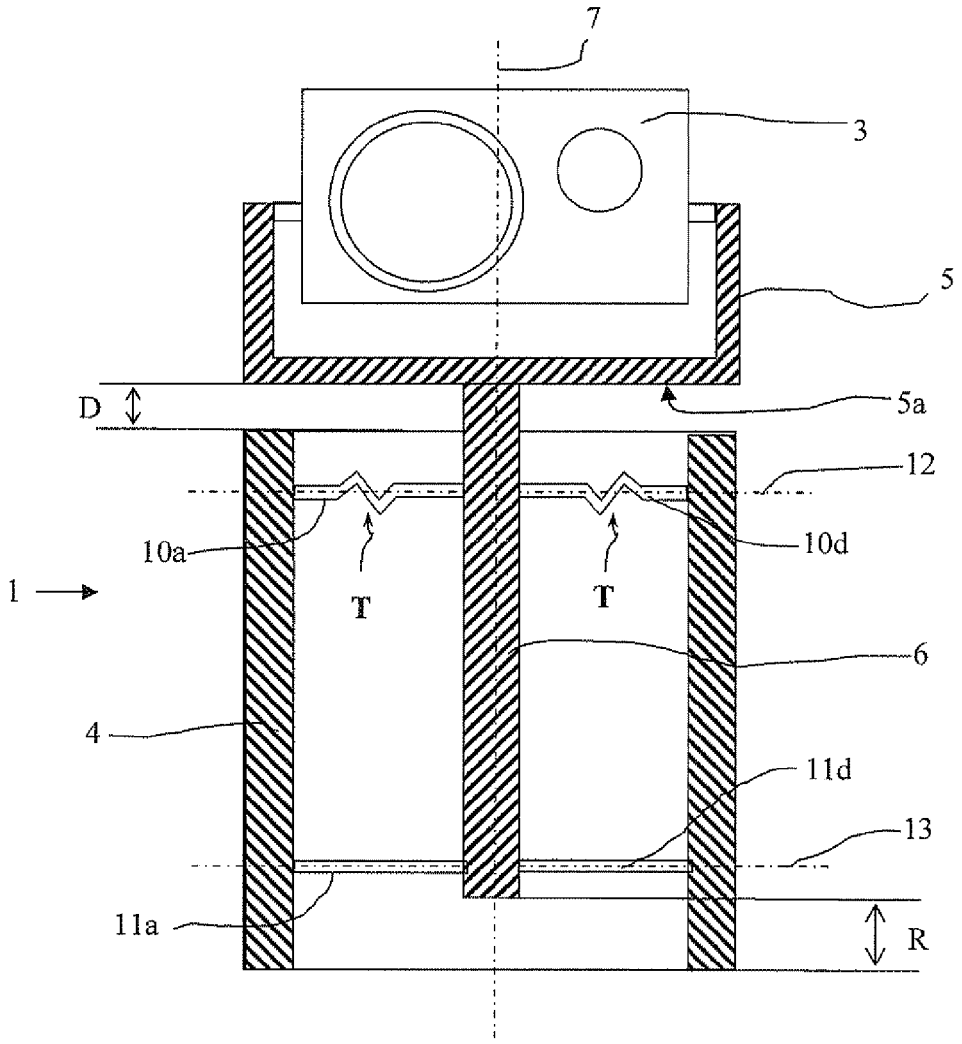
FIG. 4 shows a vertical section of a second embodiment of the device according to the invention.

FIG. 4 shows another embodiment of the invention which differs from the previous one in that the springs 10*a* to 10*d* located on the upper plane 12 are not plane but are tongues having a specific profile having at least one wave T between the two ends. Such a wave reduces the tensile and compression stress in the tongue.

This embodiment enables the dimensioning of the springs 10*a* to 10*d* arranged at the upper plane 12 and following the directions perpendicular to the vertical axis 7.

Depending on the suspension requirements, a mixture of springs with flat tongues and those with wavy tongues can be envisaged for the springs of the upper plane 12 and those of the lower plane 13.

In any event, the most important characteristic of springs 10*a* to 11*d* will nevertheless be to provide stiffness with respect to deformation following the vertical axis 7 that is less than that following all the axes perpendicular to this vertical axis 7 (or yaw axis Z).

The device can also be adapted to the level of stress and the mass of the gun sight by simply replacing the tongues. These tongues may be changed individually for adapted stiffness. The substantially linear shape of a tongue is easy to manufacture and enables easy control of its stiffness properties. Additionally, a tongue forms particular light spring means.

Figure 5:
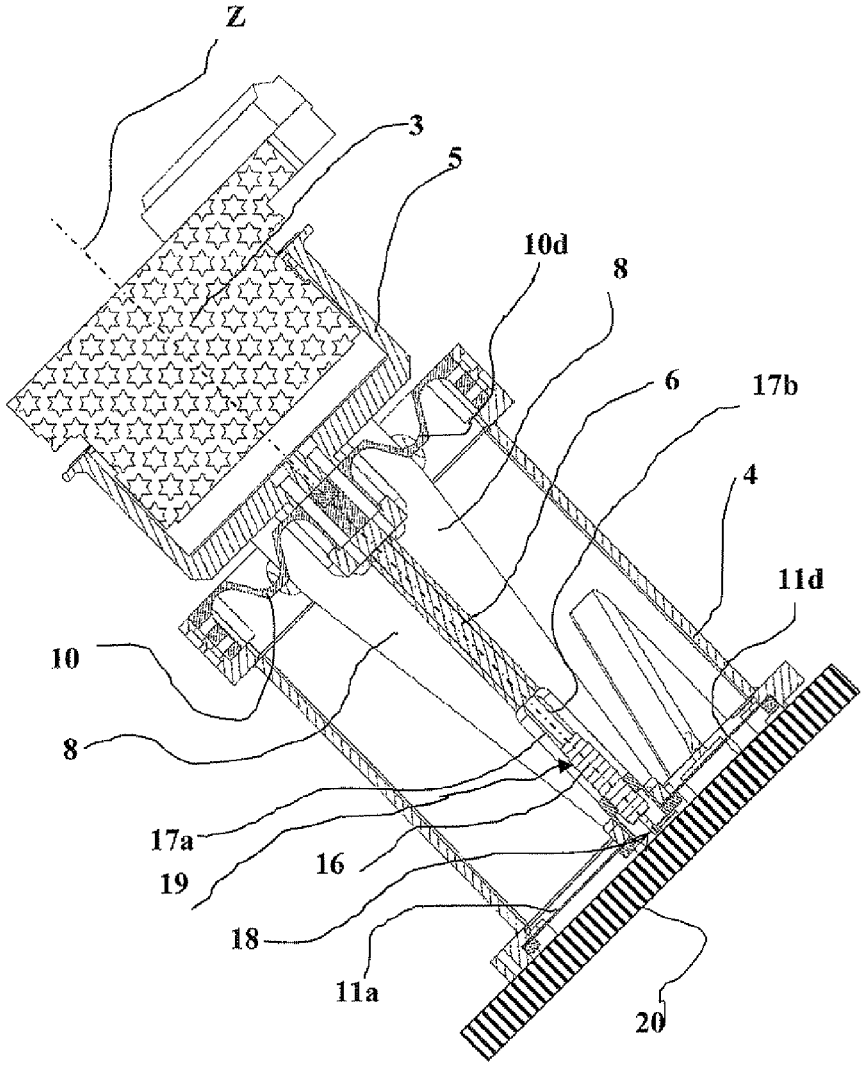
FIG. 5 shows an inclined vertical section view of another embodiment of the device equipped with oscillation-damping means.

With reference to FIG. 5 and according to another embodiment of the invention, oscillation-damping means for the column 6 are provided in the form of a telescopic isolator 16 placed coaxially to the column 6. The purpose of this element is to damp the vertical oscillations following axis Z.

A first end of the isolator element 16 incorporates threading 17*a* screwed into female threading 17*b* in the column 6. The second end of the telescopic isolator 16 incorporates a rod 18 sliding in the body 19 of the isolator 16.

Figure 6:
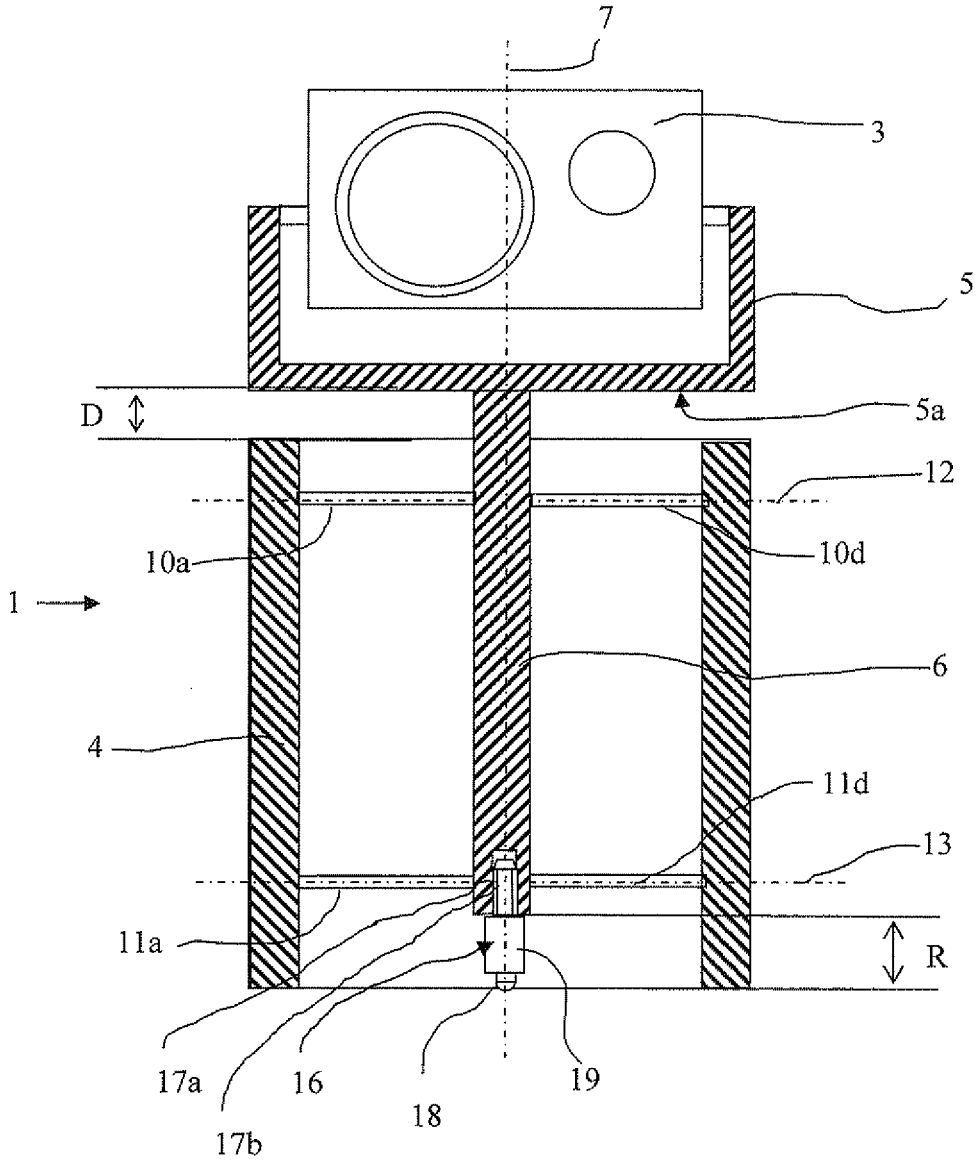
FIG. 6 shows a schematic vertical section view of one embodiment of the support equipped with oscillation-damping means.

Once the device 1 has been mounted onto the vehicle, the end of the rod 18 is in contact with a bearing surface 20 of the vehicle (bonnet, roof, assembly surface). During stresses following axis Z, the rod 18 presses on the vehicle and is pushed into the body 19 of the isolator 16. The movements of the gun sights 3 downwards are thus damped. The rod 18 is not integral with the bearing surface 20, so the column 6 is free to return to its initial position without being subjected to any friction within the telescopic isolator 16 that would risk causing hysteresis phenomena detrimental to the sight's accuracy. The particulars concerning the isolator 16 and its assembly can be better seen in FIG. 6.

According to another embodiment not shown, friction wings can be made integral with the column (wings in the form of pierced metallic blades). The wing assembly would be submerged in a viscous mixture contained in the body of the support that is sealed by a lower lid and an upper lid.

The column in this case passes through the upper lid and the watertightness is maintained by using one or several seals. The viscous mixture can be constituted by oil. The lamination of the viscous mixture by the wings improves the damping of oscillations following the vertical axis Z. The geometry of the wings can be more or less wide or may have holes to increase the lamination in the viscous mixture contained in the body.

The wings submerged in the viscous mixture thus constitute other means to damp the oscillations of the column.

What is claimed is:

1. A support device for a gun sight of a military vehicle, the support device comprising:

a head to which said gun sight is fastenable;

a foot which is attachable to said vehicle;

a column that is integral with the head, the column having a center axis oriented along a center axis of the foot; and a plurality of springs that connect the column to the foot, each spring having (i) a length in a length direction extending between the column and the foot, (ii) a thickness in a thickness direction parallel to the center axis and perpendicular to the length direction, and (iii) a width in a width direction perpendicular to the center axis and perpendicular to the length direction, wherein the springs each have a rectilinear tongue portion arranged along at least one plane perpendicular to the center axis of the foot, the thickness of each spring being less than the width, each spring applying an urging force in a direction transverse to its length direction when the column moves relative to the foot.

2. A support device according to claim 1, wherein said column is rigidified by at least one ribbing integral with said column and said head.

3. A support device according to claim 1, wherein said foot has a square sectioned tubular shape.

4. A support device according to claim 3, wherein the springs are arranged along at least two parallel planes perpendicular to the center axis of the column, such that some of the springs are in one of the parallel planes and some of the springs are in another one of the parallel planes, each plane including four springs, the springs being arranged along diagonals of said square sectioned tubular shape.

5. A support device according to claim 4, wherein each of said springs has a rectangular cross section, and the connection between the column and the foot has less stiffness along the center axis of the foot than along a direction perpendicular to the foot.

6. A support device according to claim 5, wherein said springs arranged on at least one of the planes include a non-planar section, the non-planar section including at least one wave, the wave enabling tensile and compressive deformation capacity of the springs to be increased.

7. A support device according to claim 6, wherein said springs are made of spring steel.

8. A support device according to claim 7, further comprising damping means for damping oscillations of said column.

9. A support device according to claim 8, wherein said damping means comprises a telescopic shock isolator.

10. A support device according to claim 1, wherein the connection between the column and the foot has less stiffness along the center axis of the foot than along a direction perpendicular to the foot.

11. A support device according to claim 1, wherein the springs are arranged along at least two parallel planes perpendicular to the center axis of the column, such that some of the springs are on one of the parallel planes and some of the plane springs are on another one of the parallel planes, and said springs arranged on at least one of the planes include a non-planar section, the non-planar section including at least one wave, the wave enabling tensile and compressive deformation capacity of the springs to be increased.

12. A support device according to claim 1, wherein the springs are arranged along at least two parallel planes perpendicular to the center axis of the column, such that some of the springs are on one of the parallel planes and some of the plane springs are on another one of the parallel planes.

13. A support device according to claim 1, wherein each spring has a rectangular cross section.

14. A combination, comprising a military vehicle and a gun sight, the gun sight being attached to the military vehicle by a support device according to claim 1.

15. A support device according to claim 12, wherein the springs are evenly spaced angularly around the column.

* * * * *